US006119382A

United States Patent [19]

Hakkert

[11] Patent Number: 6,119,382

[45] Date of Patent: Sep. 19, 2000

[54] DISPLAY DEVICE

[76] Inventor: Roelof Martinus Hakkert, Geleenstraat 43 III, NL-1078 LD Amsterdam, Netherlands

[21] Appl. No.: 08/930,543

[22] PCT Filed: Jan. 17, 1996

[86] PCT No.: PCT/NL96/00032

§ 371 Date: Oct. 1, 1997

§ 102(e) Date: Oct. 1, 1997

[87] PCT Pub. No.: WO96/31862

PCT Pub. Date: Oct. 10, 1996

[30] Foreign Application Priority Data

| | | | |
|---|---|---|---|
| Apr. 5, 1995 | [NL] | Netherlands | 1000056 |
| Sep. 7, 1995 | [NL] | Netherlands | 1001149 |
| Sep. 13, 1995 | [NL] | Netherlands | 1001190 |

[51] Int. Cl.[7] ..... G09F 19/00

[52] U.S. Cl. ..... 40/406; 40/427

[58] Field of Search ..... 40/406, 409, 427

[56] References Cited

U.S. PATENT DOCUMENTS

| | | | |
|---|---|---|---|
| 2,667,001 | 1/1954 | Sheridan | 40/406 |
| 5,617,657 | 4/1997 | Kahn | 40/406 |
| 5,819,452 | 10/1998 | Hakkert | 40/406 |

*Primary Examiner*—Cassandra H. Davis
*Attorney, Agent, or Firm*—Young & Thompson

[57] ABSTRACT

An imaging device includes a light source, an image carrier and an effervescence generator that includes a liquid-containing unit and propagation unit for gas and for liquid contained in the liquid-containing unit. The effervescence generator and the light source are arranged at a first side of the image carrier, and light is projected through at least a part of the effervescence generator and through the image carrier in order to obtain a combined image at the second side situated opposite the first side of the image carrier. The liquid is purified water to which a surface tension-reducing agent has been added.

15 Claims, 6 Drawing Sheets

DISPLAY DEVICE

BACKGROUND OF THE INVENTION

The invention relates to an imaging device comprising a light source, an image carrier and an effervescence generator comprising a liquid-containing unit and propagation means for gas and for liquid contained in the liquid-containing unit wherein the effervescence generator and the light source are arranged at a first side of the image carrier, and wherein means are provided for controlled light projection through at least a part of the effervescence generator and through the image carrier in order to obtain a combined image at the second side situated opposite the first side of the image carrier.

Such an imaging device is known from the international patent application PCT/NL94/00328. This known imaging device has a liquid-containing unit comprising a submersible pump which, together with a pipe running through the liquid-containing unit, forms a closed circuit. Water is pumped through the pipe while at the same time the submersible pump draws in air which can escape in the form of bubbles through holes provided in the wall of the pipe. In this way bubbles rise in the effervescence generator and their image in combination with the image fixed on the image carrier is visible outside the imaging device.

Basically, these known imaging devices comply with various desirable optical effects. For instance a moving picture, such as a waterfall, can be produced or, more usual, the imaging device can be placed indoors or outdoors for advertising purposes, in particular for bubbling or carbonated drinks. For an expert it will be obvious that such drinks may be both alcoholic and non-alcoholic.

However, the known imaging device is not always suitable for procuring the desired illusion for someone observing the image created by means of the imaging device, viz. said device requires further improvement. A first problem with the known imaging device is that the bubbles in the liquid-containing unit follow a fairly uncontrolled path and that the size of the bubbles is such that a true-to-nature reproduction of the bubbling drink or beer or champagne is not very easily produced.

Another problem of the known imaging device is that the reproduction of a dynamic flow, other than upward, cannot be realized.

A third problem is that the rotating or swirling bubbling up of the bubbles in the known device does not correspond with the fairly linear movement of bubbles in a standing glass of carbonated drink.

A fourth problem is that the dynamic flow effects which occur, for instance when pouring a glass of soft drink or beer, cannot be imitated in the known imaging device.

The invention intends to solve these and other problems and to provide further advantages which will be elucidated below.

SUMMARY OF THE INVENTION

The imaging device according to the invention is characterized in that the liquid in the liquid-containing unit is purified water to which a surface tension-reducing agent is added. Purified water in this context means demineralized or distilled water, such that the growth of algae or other elements interfering with the image, is suppressed.

The addition of a surface tension-reducing agent to the water has been shown to provide an image much truer to the nature of bubbles rising in carbonated drinks.

This aim is achieved in two respects. On the one hand the size of the bubbles is smaller than without the addition of a surface tension-reducing agent and on the other hand, the additive increases the number of bubbles, which enhances the desired visual effect.

In particular the addition of a cooling liquid-antifreeze on glycol basis was shown to contribute to the realization of the invention's aim. Moreover, such a medium has the advantage that the application of the imaging device remains possible outdoors and in wintry conditions. A suitable medium for this purpose is the product glysantin®, as marketed by BASF AG.

It is desirable that the liquid-containing unit is closed all-round to prevent pollution and loss of liquid and gas. In this way long-term low-maintenance operation of the imaging device according to the invention is possible without frequent replenishment of the water level in the liquid-containing unit or of the relatively quickly evaporating surface tension-reducing agent.

In a particular embodiment of the imaging device according to the invention the liquid-containing unit is provided with a circulation system comprising a channel for the common transport of liquid and gas, and first and second return channels for liquid and gas, whereby the channel discharges into the first return channel for the liquid and into the second return channel for the gas. The advantage hereby is that by means of the channel in which common transport of liquid and gas takes place, a predominantly random flow direction can be given to the liquid containing the swirling gas bubbles. This allows the controlled creation of the illusion of a glass being poured.

It is of advantage if the second return channel for the gas runs at the upper side of the channel. This second return channel connects with and leads to a collection room for the gas and as the bubbles in the combined liquid-gas flow tend to travel upward, the bubbles that have reached the exit of the common channel are transported by means of natural forces to said collection room for the gas. Preferably the return transport of the liquid occurs at the lower side of the channel.

A very effective embodiment of the device according to the invention is one in which the propagation means for the gas and the liquid comprise a submersible pump and a venturi which is coupled to supply the second return channel for the gas. In this way, depending on the amount of pumped liquid, a corresponding amount of gas is supplied to the stream of liquid by means of the venturi action so that, while maintaining the obtained swirling effect for the observer, the dynamic character of a stream of liquid containing bubbles, can be imitated.

In another embodiment a plate is incorporated in the liquid-containing unit, and during operation the propagation means for gas and for liquid contained in the liquid-containing unit provide a flow of bubbles directed at the plate. This creates a clean flow of bubbles from the bottom to the top giving a very true-to-nature imitation of a standing glass of liquid containing bubbles.

This is achieved in particular if the plate is placed horizontally at the bottom of the liquid-containing unit. Preferably the liquid-containing unit is furnished with a circulation system comprising a first channel for liquid and a second channel for gas, and that the first channel and the second channel connect to a diffuser for directed outflow of bubbles aimed at the plate.

In yet another embodiment of the imaging device according to the invention the plate is placed slantingly in the liquid-containing unit, and the propagation means for the gas and liquid comprise a submersible pump as well as a venturi which is coupled to supply the gas collection room in the liquid-containing unit, and during operation the bubble stream from the venturi is directed obliquely at the plate. By means of this embodiment a very true-to-nature imitation can be created of, for instance an obliquely downward swirling liquid as is found, for instance, in a professionally drawn lager whereby the creation of the illusion of a head forming is also important.

In all the embodiments of the imaging device according to the invention it may be advantageous to place the light source substantially in the plane of the effervescence generator. This allows the light coming from the light source at the side, for instance, to shine into the water from above, giving a very attractive light effect.

To enhance the effects described it is desirable to place a mirror at the side of the effervescence generator facing away from the image carrier. In this way the observer sees double the bubble production.

It has been shown that the imaging device according to the invention functions optimally if the image carrier used is a transparent chiba chromium slide.

A very easily employable imaging device is provided by forming the liquid-containing unit from a flat perspex plate drawn into shape by means of vacuum, which is closed off by a further perspex plate to form the channels of the circulation system. This makes the use of the imaging device for advertising very attractive because of the considerable weight-saving that can be achieved due to the small amount of liquid in the unit.

As will be clear from the above, the invention is also embodied in a loose effervescence generator constituting part of the imaging device according to the invention as described above.

BRIEF DESCRIPTION OF THE DRAWINGS

The invention will now be further elucidated with reference to the drawing, in which.

DESCRIPTION OF THE PREFERRED EMBODIMENTS

The general construction of the imaging device as relative to the invention, is known form the international patent application PCT/NL94/00328 which, by this reference, shall be considered to be incorporated herein.

Figure 1:
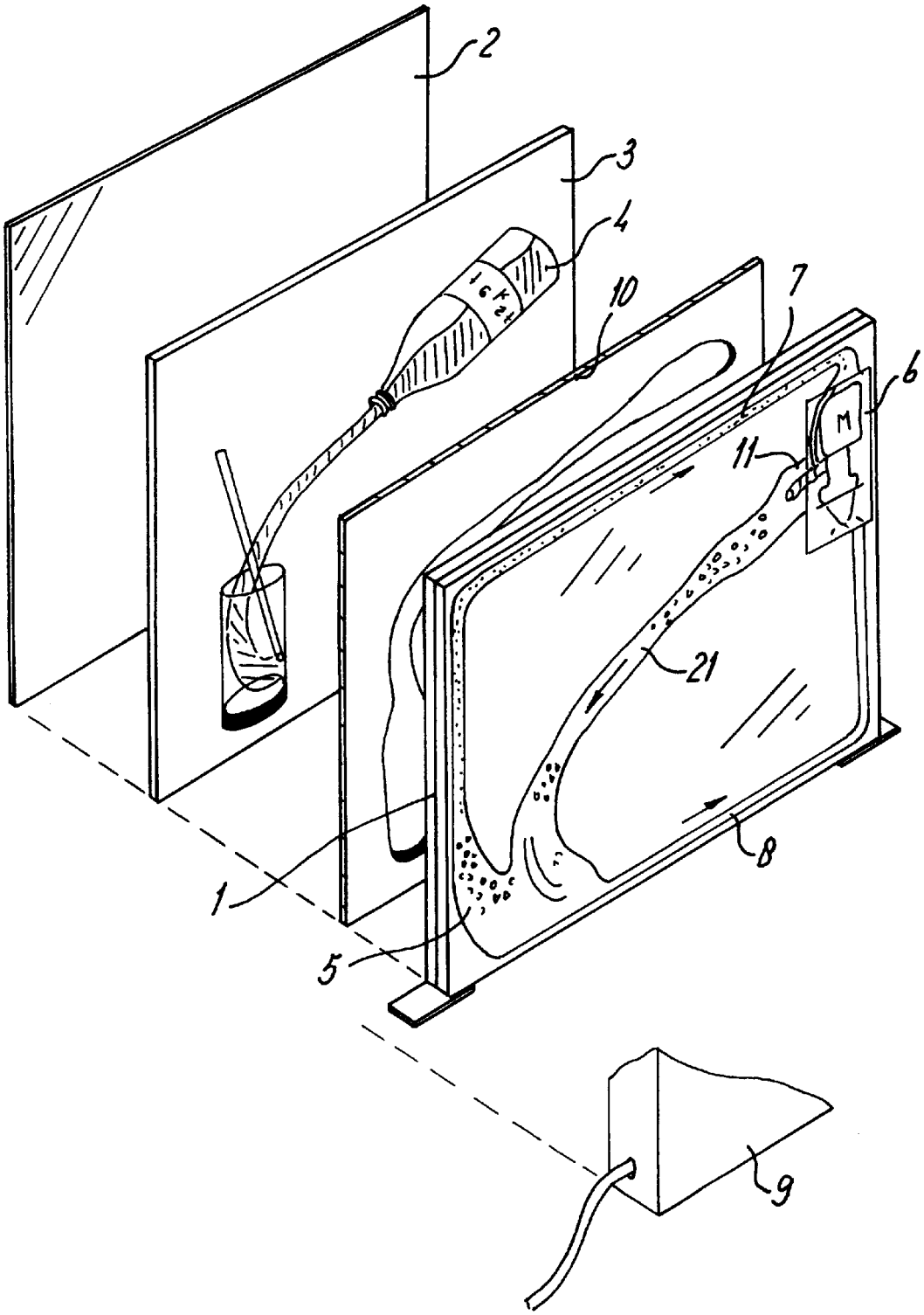
FIG. 1 shows an exploded view of a first embodiment of the imaging device according to the invention.

FIG. 1 shows a first embodiment of an imaging device according to the invention, wherein an effervescence generator 1 is used containing the idea of the invention. From a light source 9, as seen in the direction of the observer, an effervescence generator 1, a screening plate 10, an image carrier 3 and a cover plate 2 are provided. The image carrier 3 shows an image 4 which is to be combined with the image of the bubbling liquid stream generated by means of the effervescence generator 1. To this end the liquid-containing unit of the effervescence generator is provided with a circulation system comprising a submersible pump 6 which is provided with a venturi 11 supplying a channel 21 serving for the common transport of liquid and gas, discharging at 5 into a first return channel 8 for the liquid and a second return channel 7 for the gas. The second return channel 7 for the gas runs preferably at the upper side of the channel 21 and it is advantageous for the first return channel for the liquid to run at the lower side of the channel 21. The flow is kept moving by means of the submersible pump 6 which connects to the first return channel 8. The venturi connects to the second return channel for the gas.

Figure 2:
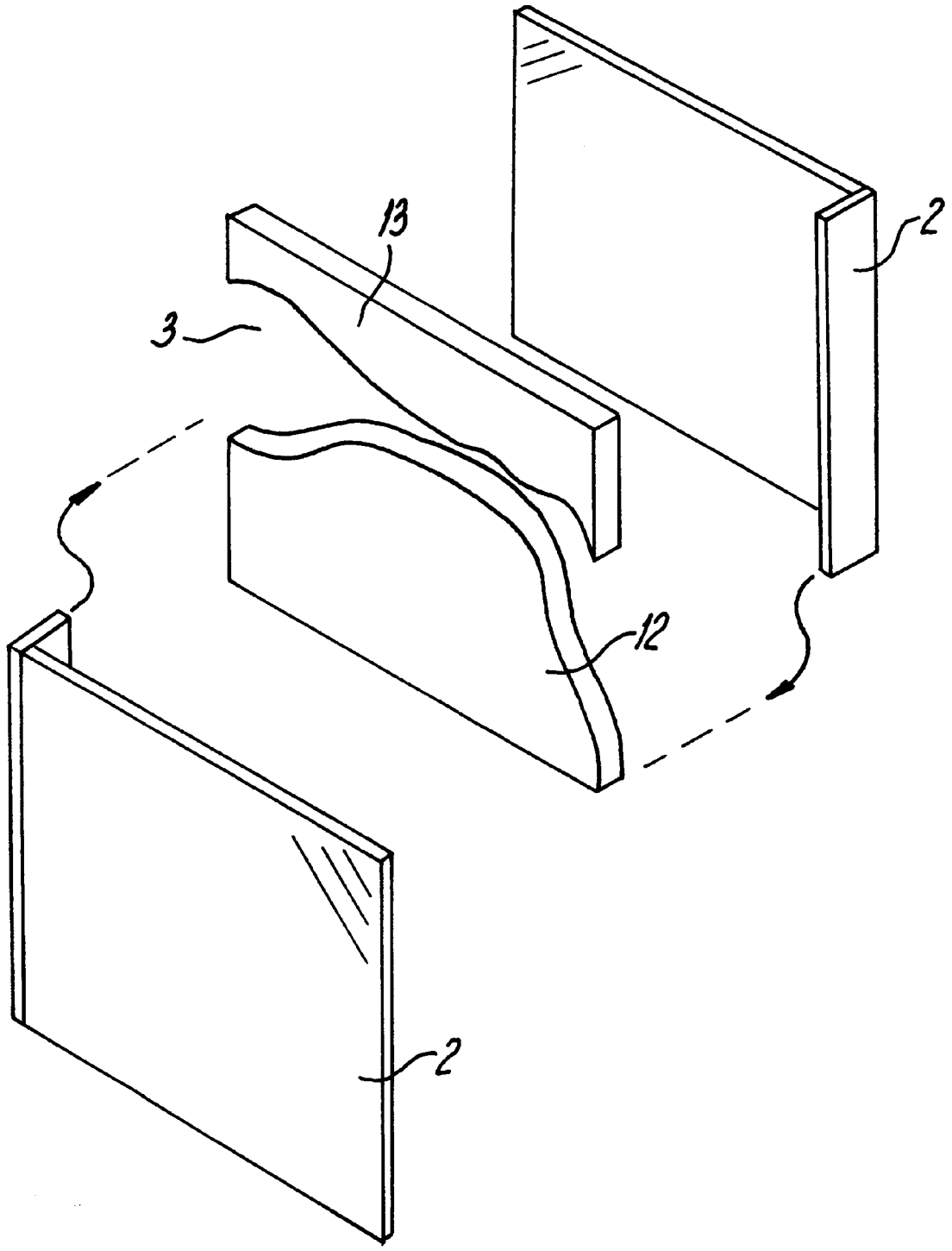
FIG. 2 shows an exploded view of several parts of the liquid-containing unit of the effervescence generator to be employed in the imaging device of FIG. 1.
Figure 3:
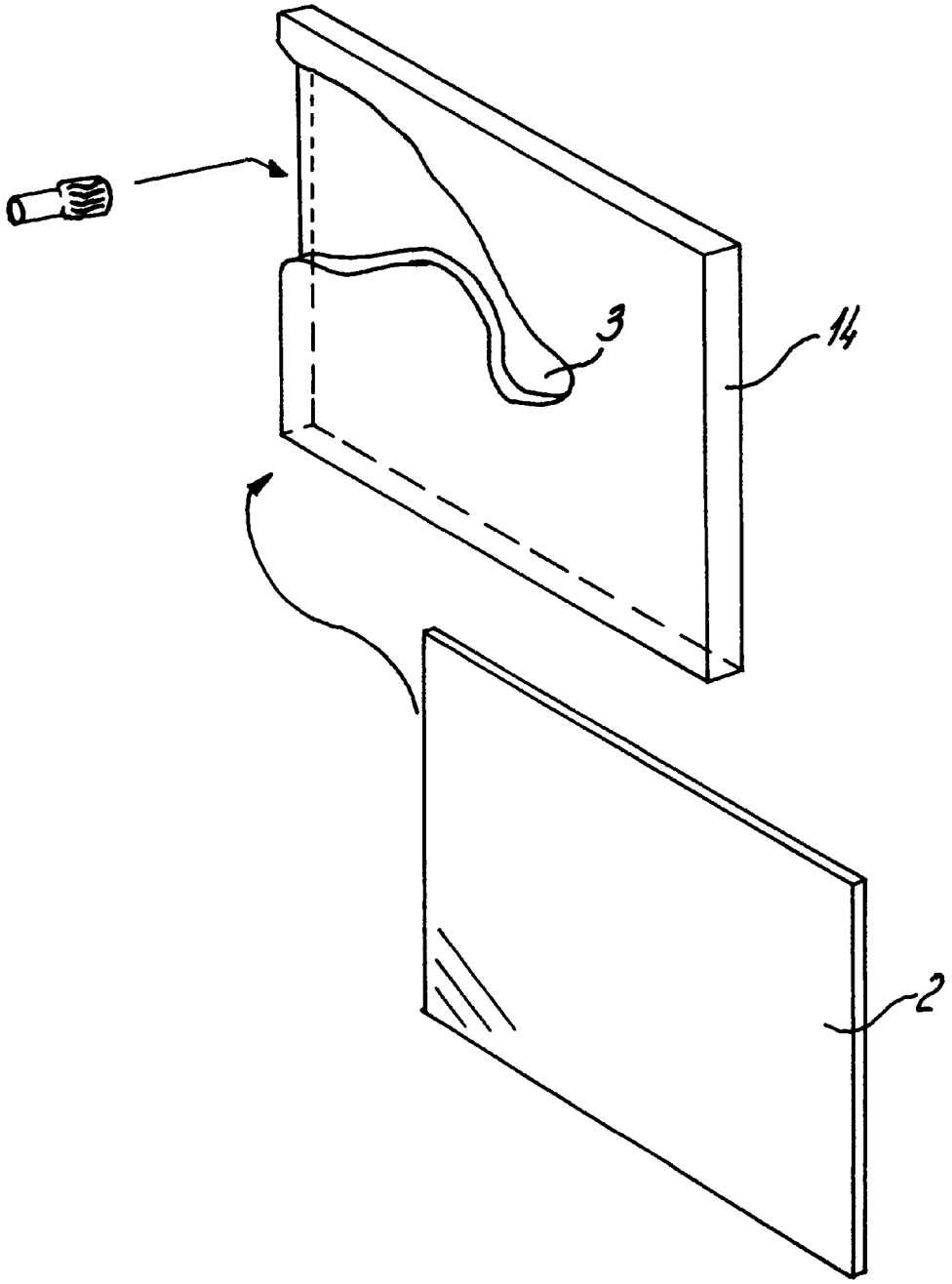
FIG. 3 shows a number of parts of another embodiment of the liquid-containing unit of the effervescence generator to be employed in the imaging device of FIG. 1.

FIGS. 2 and 3 show a conceivable assembly of the liquid-containing unit 1. FIG. 2 shows that the channel-forming parts are formed by two perspex plates 12 and 13 placed between two sealing plates 2 of clear perspex. Alternatively, perspex parts may be moulded or cut to the desired shape as shown in FIG. 3, in which case a single cover plate 2 will suffice. Naturally, the shape of the channel-forming parts or the cut-out single perspex plate 14 (see FIG. 3) must correspond to the place where, in the combined image which is visible at the outside of the imaging device, the bubbling liquid is to be seen. The liquid-containing unit is preferably obtained from a flat perspex plate drawn into shape by means of vacuum (not shown) and sealed by means of another perspex plate to form the channels of the circulation system. This makes application of the imaging device for advertising very attractive because of the considerable weight-saving that can thus—due to the small amount of liquid in the unit—be achieved.

The screening plate 10 (see FIG. 1) which is placed between the effervescence generator (the liquid-containing unit) 1 and the image carrier 3, is usually a milk white perspex plate provided with a recess where the images of the effervescence generator and the image carrier 3 are to coincide.

By application of the submersible pump 6 and the venturi 11 it is possible to control the adjustment of the flow velocity and the liquid/gas ratio. The liquid used in the liquid-containing unit 1 must be purified, that is to say demineralized or distilled in order to prevent the growth of algae and the like. Moreover, it is preferable to add a surface tension-reducing agent. This results in smaller and more bubbles. The surface tension-reducing agent is preferably a cooling liquid-antifreeze on glycol basis. For this purpose glysantins, a registered trademark of BASF AG, is recommended.

Figure 4:
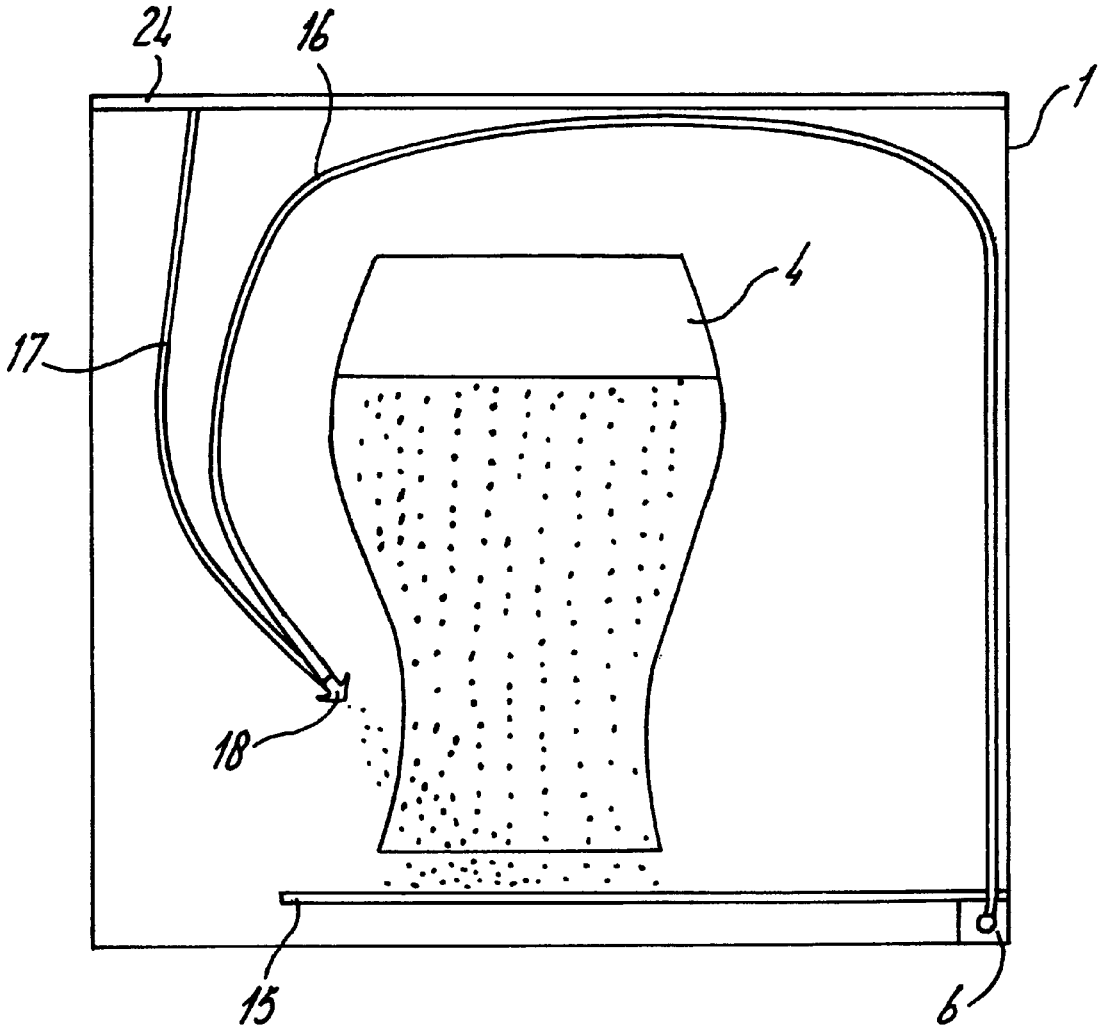
FIG. 4 shows in a schematic front view an arrangement of several parts of the imaging device according to the invention in a second embodiment.

A schematic front view of a second embodiment of the effervescence generator 1 is shown in FIG. 4. This embodiment is particularly suitable to produce a combined image having a stream of bubbles which rises substantially linearly, from the bottom upward. To this end the effervescence generator comprises a plate 15 which is placed horizontally at the bottom of the liquid-containing unit 1. A submersible pump 6 feeds a channel 16 which discharges at 18 into a diffuser, which is simultaneously fed, via a pipe 17, with gas from a collection room 24. At 18 the manifold discharges the stream of bubbles into the direction of the plate 15, which stream of bubbles rises from there in a substantially linear movement, thus realizing, in combination with the image 4 (see FIG. 1), the illusion of a glass filled with a soft drink or beer.

Figure 5:
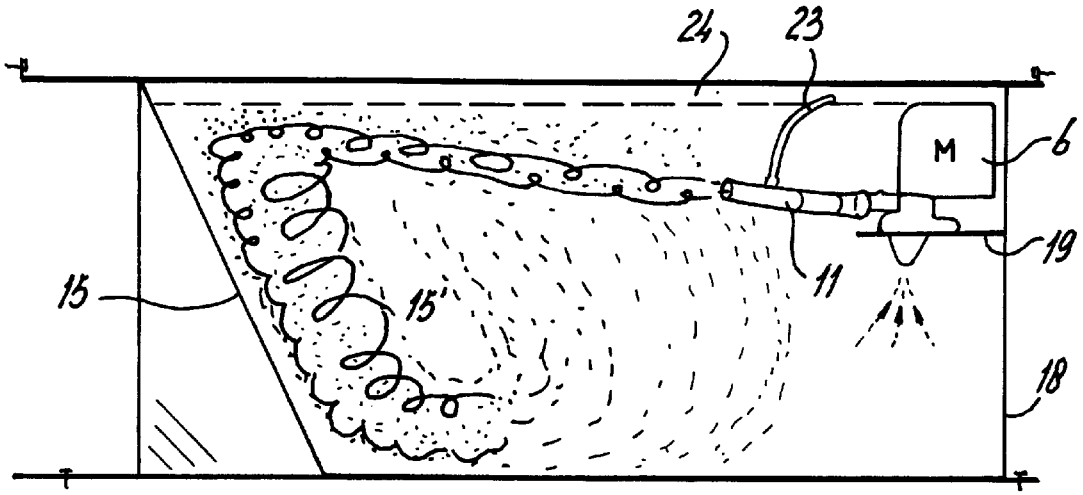
FIG. 5 shows schematically the effervescence generator according to a third embodiment of the imaging device according to the invention.

FIG. 5 shows a schematic front view of the effervescence generator according to the invention. The housing of the effervescence generator may, for instance, be formed from 3½ mm thick material on an acrylate basis. A submersible pump 6 is placed on a support plate 19 in the effervescence generator. The submersible pump 6 feeds a venturi 11 which is connected via an air pipe 23 with a collection room 24 for gas. The liquid/gas mixture leaving the venturi 11 is directed under an oblique angle at a now slopingly positioned plate 15, producing in the effervescence generator a swirling effect indicated by reference number 15'. As already explained above, in this arrangement also the water must be purified and provided with a surface tension-reducing agent.

Figure 6:
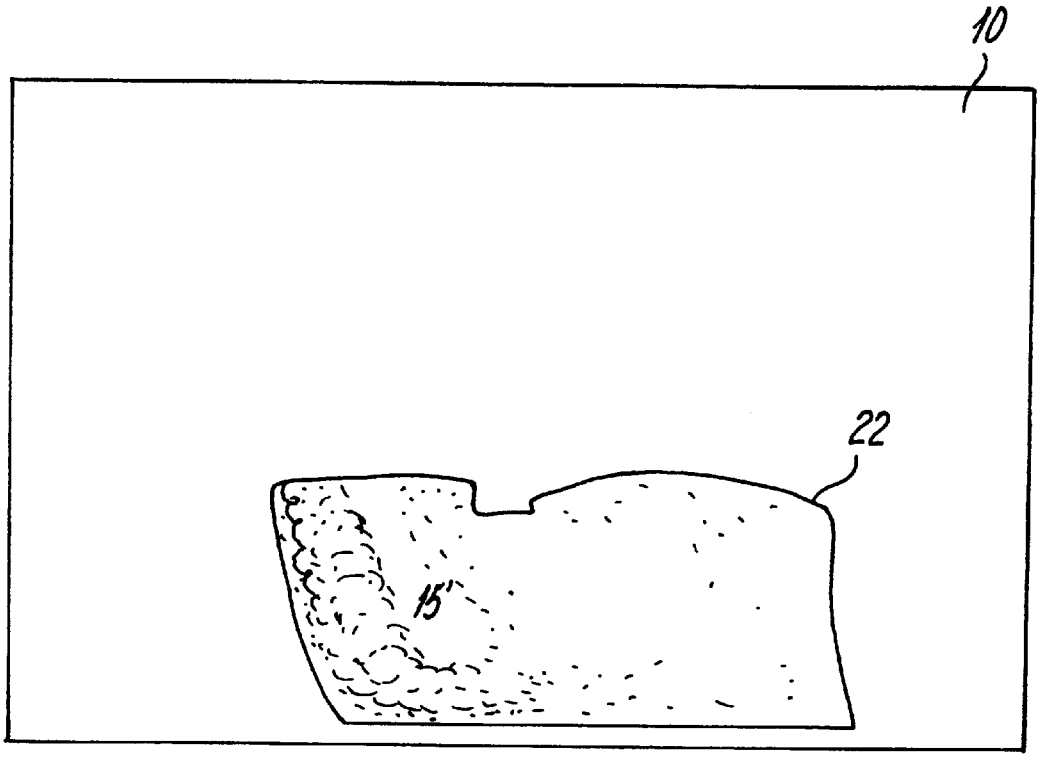
FIG. 6 shows a view of the effervescence generator with an intermediate plate placed in front of it.

FIG. 6 shows the front view wherein a screening plate 10 is placed in front of the effervescence generator, which screening plate 10 is provided with a recess 22.

Figure 7:
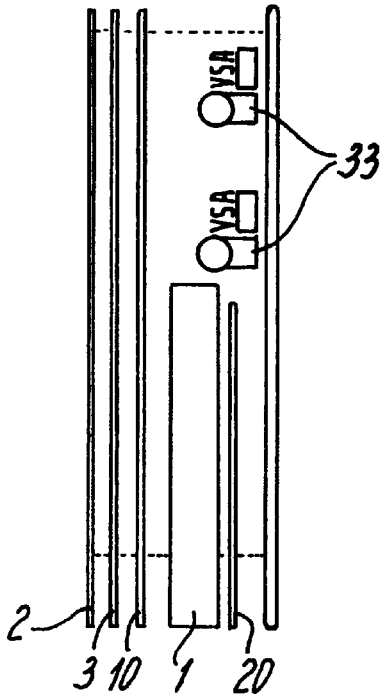
FIG. 7 presents a schematic side view of the effervescence generator for use in the imaging device according to the invention.

For further clarification FIG. 7 shows a schematic cross-section of the imaging device according to the invention. This Figure clearly shows an application provided at the top of the liquid-containing unit with light fittings 33. The effervescence generator may be constructed in any way as described above. Preferably there is a mirror 20 provided behind the effervescence generator 1, by which means intensification and magnification of the desired optical effervescent effect is obtained. At the other side, toward the observer, in succession screening plate 10, image carrier 3 and cover plate 2 are provided. Another function of this latter cover plate 2 is to prevent the visual effect being disturbed due to false light falling onto the imaging device.

Figure 8:
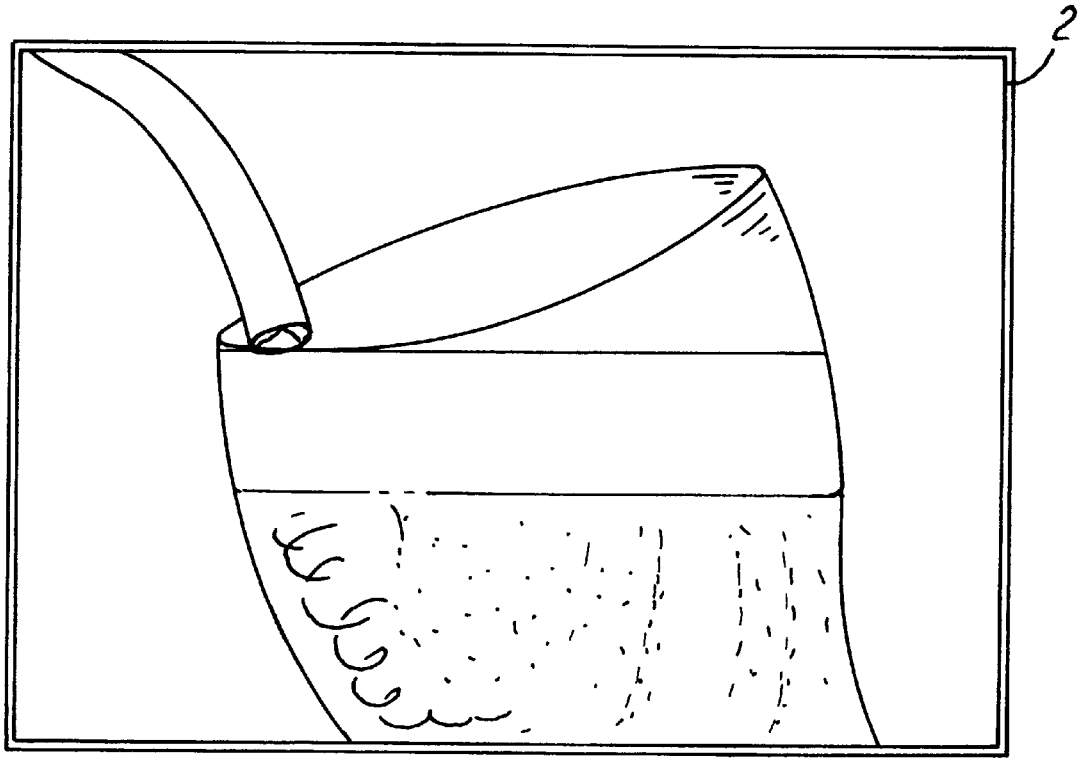
FIG. 8 a view of the visual effect that can be obtained by means of an integral imaging device according to the invention.

Finally, in FIG. 8, the optical illusion is shown as it may be generated on the side of the cover plate 2 facing the observer, by means of the imaging device according to the invention; in this case it is a glass of draft beer in which the swirling effects of the beer pouring in are visible, and where on the top of the beer a head appears to form.

The imaging device according to the invention may be applied in various versions and in sundry situations. Both indoor and outdoor applications are possible and in various dimensions, without departing from the underlying idea as specified in the following claims.

What is claimed is:

1. An imaging device comprising a light source, an image carrier and an effervescence generator comprising a liquid-containing unit and propagation means for gas and for-liquid contained in the liquid-containing unit, wherein the effervescence generator and the light source are arranged at a first side of the image carrier, and wherein means are provided for controlled light projection through at least a part of the effervescence generator and through the image carrier in order to obtain a combined image at a second side situated opposite the first side of the image carrier, wherein the liquid is purified water to which a surface tension-reducing agent has been added.

2. An imaging device according to claim 1, wherein the surface tension-reducing agent is a cooling liquid-antifreeze on glycol basis.

3. An imaging device according to claim 1, wherein the liquid-containing unit (1) is closed all round to prevent pollution and loss of liquid and gas.

4. An imaging device according to claim 1, wherein the liquid-containing unit (1) is provided with a circulation system comprising a channel (21) for the common transport of liquid and gas, and first and second return channels (7,8) for liquid and gas, whereby the channel (21) discharges into the first return channel (8) for the liquid and into the second return channel (7) for the gas.

5. An imaging device according to claim 4, wherein the second return channel (7) runs along a top of the channel (21).

6. An imaging device according to claim 4, wherein the propagation means for the gas and the liquid comprise a submersible pump (6) as well as a venturi (11) which is connected to supply the second return channel (7) with the gas.

7. An imaging device according to claim 1, wherein a plate (15) is incorporated at a bottom of the liquid-containing unit (1), and that during operation the propagation means for the gas and the liquid contained in the liquid-containing unit (1) provide a flow of bubbles directed toward the plate.

8. An imaging device according to claim 7, wherein the plate (15) is placed horizontally at the bottom of the liquid-containing unit (1).

9. An imaging device according to claim 7, wherein the liquid-containing unit (1) is provided with a circulation system comprising a first channel (16) for liquid and a second channel (17) for gas, and that the first and the second channel connect with a diffuser (18) for the directed outflow of bubbles the plate (15).

10. An imaging device according to claim 7, wherein the plate (15) is slopingly positioned in the liquid-containing unit (1) and that the propagation means for the gas and the liquid comprise a submersible pump (6) as well as a venturi (11) which is connected to feed a collection room (24) for gas, which connection room is present in the liquid-containing unit (1), and that during operation the bubble flow from the venturi (11) is directed obliquely at the plate (15).

11. An imaging device according to claim 1, wherein the light source (33) is placed substantially in a plane with the liquid-containing unit (1).

12. An imaging device according to claim 1 wherein a mirror (20) is placed at a side of the effervescence generator (1) facing away from the image carrier (3).

13. An imaging device according to claim 1, wherein the image carrier (3) is a transparent chiba chromium slide.

14. An imaging device according to claim 1, wherein the liquid-containing unit (1) is a flat perspex plate drawn into shape by means of vacuum, which shaped perspex plate is closed off by a flat perspex plate to form the channels of the circulation system.

15. An effervescence generator as described as part of the device according to claim 1.

* * * * *